US011827038B2

(12) United States Patent
Kameda

(10) Patent No.: US 11,827,038 B2
(45) Date of Patent: Nov. 28, 2023

(54) NAIL PRINTING APPARATUS AND CONTROL METHOD

(71) Applicant: CANON KABUSHIKI KAISHA, Tokyo (JP)

(72) Inventor: Hirokazu Kameda, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 2 days.

(21) Appl. No.: 17/701,811

(22) Filed: Mar. 23, 2022

(65) Prior Publication Data

US 2022/0305826 A1 Sep. 29, 2022

(30) Foreign Application Priority Data

Mar. 26, 2021 (JP) ..... 2021-053238

(51) Int. Cl.
*B41J 3/407* (2006.01)
*B41J 25/308* (2006.01)

(52) U.S. Cl.
CPC ..... *B41J 25/308* (2013.01); *B41J 3/4073* (2013.01)

(58) Field of Classification Search
CPC .... B41J 3/4073; B41J 3/40731; B41J 25/308; A45D 2029/005
See application file for complete search history.

(56) References Cited

U.S. PATENT DOCUMENTS

2021/0229464 A1* 7/2021 Takagi ..... B41J 3/407
2022/0379638 A1* 12/2022 Yamasaki ..... B41J 25/006

FOREIGN PATENT DOCUMENTS

WO 01/91598 A1 12/2001

OTHER PUBLICATIONS

Soma Nakai et al., U.S. Appl. No. 17/706,728, filed Mar. 29, 2022.
Yuka Tani et al., U.S. Appl. No. 17/706,670, filed Mar. 29, 2022.
Keisuke Arita et al., U.S. Appl. No. 17/690,113, filed Mar. 9, 2022.
Naoya Ogawa et al., U.S. Appl. No. 17/695,887, filed Mar. 16, 2022.

* cited by examiner

*Primary Examiner* — Scott A Richmond
(74) *Attorney, Agent, or Firm* — VENABLE LLP

(57) ABSTRACT

A nail printing apparatus includes a print head that prints an image on a nail, a finger rest that is a rest on which a finger is placed and that is movable in a height direction, and a sensor that is arranged at a position above the finger rest as well as below the print head in the height direction and that is movable in a movement direction and capable of detecting a nail within a detection range. A control unit controls height adjustment in which the sensor is moved in the movement direction so that a first position of a nail area is included in the detection range of the sensor and then the finger rest is moved upward until the sensor detects the nail.

16 Claims, 9 Drawing Sheets

| FIG.5A | FIG.5B |
|---|---|

SCREEN IN A CASE WHERE THE DESIGNS ARE SET

SCREEN IN A CASE WHERE THE DESIGNS HAVE NOT BEEN SET

| FIG.7A |
| --- |
| FIG.7B |

NAIL PRINTING APPARATUS AND CONTROL METHOD

BACKGROUND OF THE DISCLOSURE

Field of the Disclosure

The present disclosure relates to a nail printing apparatus, and a control method.

Description of the Related Art

There is a method for printing nail art on a nail of a person to be printed by use of a printer. Hereinafter, the printer that prints nail art on a nail will be referred to as a nail printing apparatus. In the nail printing apparatus, the height of the nail may be adjusted so that the position of the printing target nail relative to the print head will become appropriate.

In International Publication No. 01/091598, usage of a sensor to adjust the height of a holder on which a finger of the person to be printed is placed is described.

Such a configuration in which a nail of the person to be printed is detected by the sensor and the height of the holder is adjusted based on the result is conceivable. However, the position of the nail on the holder varies depending on the person to be printed. If the position of the nail on the holder is not known before the height adjustment, the sensor may not be able to properly detect the nail of the person to be printed. Therefore, there is a possibility that the height of the printing target nail cannot be adjusted properly.

SUMMARY OF THE DISCLOSURE

A nail printing apparatus comprising: a print head that prints an image on a nail of a person to be printed; a finger rest that is a rest on which a finger of the person to be printed is placed and that is movable in a height direction, the height direction being a direction facing the print head in a case where printing is performed on the nail; a sensor that is arranged at a position above the finger rest in the height direction as well as below the print head in the height direction, and that is movable in a movement direction and capable of detecting a nail within a detection range, the movement direction being a direction intersecting the height direction; and a control unit configured to perform control of height adjustment in which the sensor is moved in the movement direction so that a first position of a nail area is included in the detection range of the sensor and then the finger rest is moved upward until the sensor detects the nail, the first position of the nail area being detected based on a captured image of the finger placed on the finger rest.

Further features of the present disclosure will become apparent from the following description of exemplary embodiments with reference to the attached drawings.

DESCRIPTION OF THE EMBODIMENTS

Hereinafter, the forms of the technique in the present disclosure will be explained in detail. Note that the following embodiments are examples for explaining the technique of the present disclosure and are not intended to limit the technique of the present disclosure to those embodiments only. Further, the technique of the present disclosure can be modified in various ways to an extent that does not deviate from the gist thereof. Note that the same configurations will be explained with the same reference signs. Further, the relative positions, shapes, etc., of the constituent elements described in the following embodiments are merely examples.

First Embodiment

[System Configuration]

Figure 1:
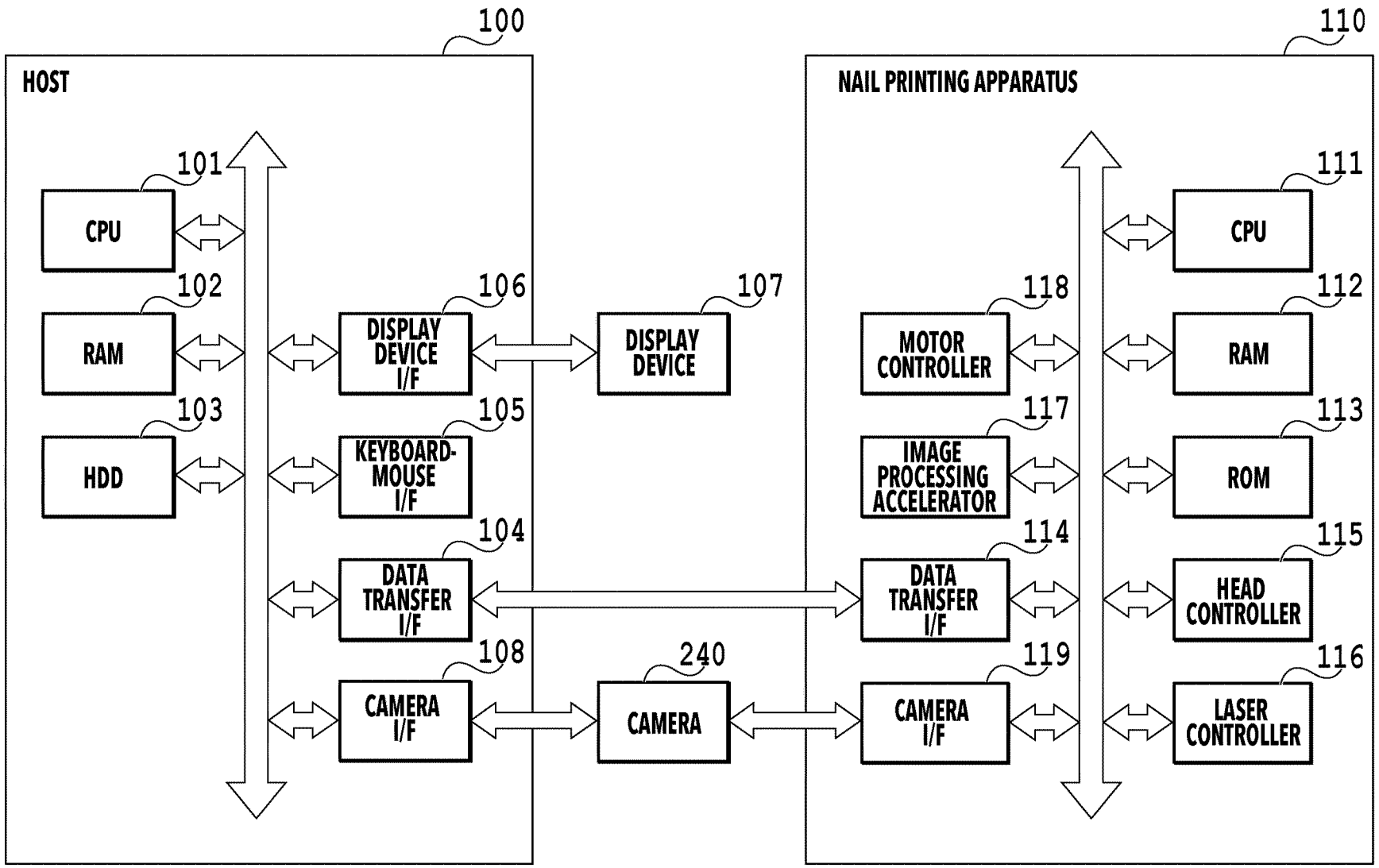
FIG. 1 is a block diagram illustrating a configuration of a printing system.

FIG. 1 is a block diagram illustrating the configuration of the printing system of the present embodiment. The printing system includes the host 100 and the nail printing apparatus 110. The nail printing apparatus 110 is an apparatus having a function of drawing an image directly on a nail of a hand of a person to be printed. Note that, although the present embodiment shows the example in which a nail of a hand is a printing target, the printing target is not limited to a hand and may be a toenail.

The host 100 is an information processing apparatus such as a personal computer (PC), for example. The host 100 may be a mobile terminal such as a smartphone. The host 100 is configured to be capable of communicating with the nail printing apparatus 110. The host 100 and the nail printing apparatus 110 are connected via a predetermined network or are directly connected without a network, so that information can be exchanged with each other. Note that, although the host 100 and the nail printing apparatus 110 will be explained as separate apparatuses in the present embodiment, such a form of using an apparatus which integrally includes the functions of both is also possible.

The host 100 has the CPU 101, the RAM 102, the HDD 103, the data transfer I/F 104, the keyboard-mouse I/F 105, the display device I/F 106, and the camera I/F 108.

The CPU 101 executes the later-described processing according to a program that is held in the HDD 103 or the RAM 102. The program includes an application program for printing a design image such as nail art on a nail with the nail printing apparatus 110. For example, an application program that sends a print job for printing an image to be printed to the nail printing apparatus 110 in response to an operation from the user is included. The application having such a function is hereinafter referred to as a nail app or simply an app. Note that the apps may have another function other than the printing function. For example, the apps in the present embodiment may have a function of activating the camera 240. That is, other than a print job, the apps may have a function of sending a camera activation job, etc. Further, the applications that are held in the HDD 103 or the RAM 102 are not limited to nail apps and may be application programs having a function other than printing. Hereinafter, a design image such as nail art is also referred to as a nail image.

The RAM 102 is a volatile storage, which temporarily holds programs and data. The HDD 103 is a non-volatile storage, which holds programs and data.

The data transfer I/F (interface) 104 controls transmission and reception of data to and from the nail printing apparatus 110. As the connection method for this transmission and reception of data, a wired connection such as USB, IEEE1394, and LAN and a wireless connection such as Bluetooth (registered trademark) and Wi-Fi (registered trademark) can be used. The data transmitted to and received from the nail printing apparatus 110 includes various kinds of control data. Further, the data transmitted to and received from the nail printing apparatus 110 includes image data of an image to be printed, which is output from the host 100 to the nail printing apparatus 110.

The keyboard-mouse I/F (interface) 105 is an I/F that controls an HID (Human Interface Device), such as a keyboard and mouse which are not illustrated in the drawings. The user can input various kinds of information via this I/F. The CPU 101 is configured to be capable of accepting instructions from the user through the keyboard-mouse I/F 105.

The display device I/F (display device interface) 106 controls displaying on the display device 107. The display device 107 is a display device of a liquid crystal, an organic EL, etc., for example. It is also possible that the display device 107 is included in the configuration of the host 100. The CPU 101 is capable of controlling displaying on the display device 107 via the display device I/F 106. Further, it is also possible that the display device 107 serves as an input unit in a form of a touch panel display device. The camera I/F 108 is an I/F for connecting to the camera 240.

The nail printing apparatus 110 includes the CPU 111, the RAM 112, the ROM 113, the data transfer I/F 114, the head controller 115, the laser controller 116, the image processing accelerator 117, the motor controller 118, and the camera I/F 119.

The CPU 111 executes the later-described processing according to programs that are held in the ROM 113 or the RAM 112. The RAM 112 is a volatile storage, which temporarily holds programs and data. The ROM 113 is a non-volatile storage, which holds various kinds of table data and programs.

The data transfer I/F (interface) 114 controls transmission and reception of data to and from the host 100.

The head controller 115 controls a heating operation of the heater board 231 (see FIG. 2) mounted on the print head 230 (see FIG. 2), based on recording data, so that ink is ejected from nozzles of the print head 230. Specifically, the head controller 115 may be configured to read control parameters and recording data from a predetermined address of the RAM 102. Further, if the CPU 111 writes a control parameter and recording data to the predetermined address of the RAM 112, the head controller 115 activates the processing, so that the heating operation is performed by the heater board 231 mounted on the print head 230.

The laser controller 116 controls the laser sensor light-emitting unit 221 (see FIG. 2) to emit a laser. The laser sensor light-emitting unit 221 is a sensor used for adjusting the height of the finger rests 251 to 254 (see FIG. 2) on which the fingers of the person to be printed, whose nails are to be printed, are placed. Details will be described later.

The image processing accelerator 117 is configured with hardware and executes image processing at a higher speed than the CPU 111. Specifically, the image processing accelerator 117 may be configured to read parameters and data required for image processing from a predetermined address of the RAM 112. Further, if the CPU 111 writes the above-described parameters and data to the above-described predetermined address of the RAM 112, the image processing accelerator 117 is activated, and predetermined image processing is performed. Note that the image processing accelerator 117 may be configured in a given manner. Depending on the specifications of the nail printing apparatus 110, etc., the processing of creating the above-described table parameters and the image processing may be executed only with the processing performed by the CPU 111.

The motor controller 118 is a control unit that controls motor operations of multiple motor units which are not illustrated in the drawings. In the present embodiment, a motor unit is used to move the print head 230 two-dimensionally relative to a printing target nail. Further, the finger rests 251 to 254 are configured to be movable in the upward direction and the downward direction, and the motor units are also used as a mechanism for raising or lowering the finger rests 251 to 254. That is, the motor controller 118 can control the heights of the finger rests 251 to 254 by controlling the motor units. Note that the method for raising or lowering the finger rests may be performed by a method other than the method using the motor units. Depending on the type of printer, a motor for maintenance of the print head may be installed.

The camera I/F 119 is an I/F for connecting to the camera 240 to obtain image data which is acquired by image-capturing with the camera 240. It is also possible that the camera 240 is connected to the host 100 via the camera I/F 108. In that case, the image data of a captured image which is acquired by image-capturing with the camera 240 may be received from the host 100 via the data transfer I/F 114, for example. Note that the camera 240 may be included in the configuration of the nail printing apparatus 110.

For example, an inkjet printer or the like whose inkjet head for recording an image by injecting ink as droplets is a print head can be applied to the nail printing apparatus 110. Further, the nail printing apparatus of the present embodiment may be a multifunction peripheral having multiple functions such as a copy function, a fax function, and a print function.

[Configuration of the Nail Printing Apparatus]

Figure 2:
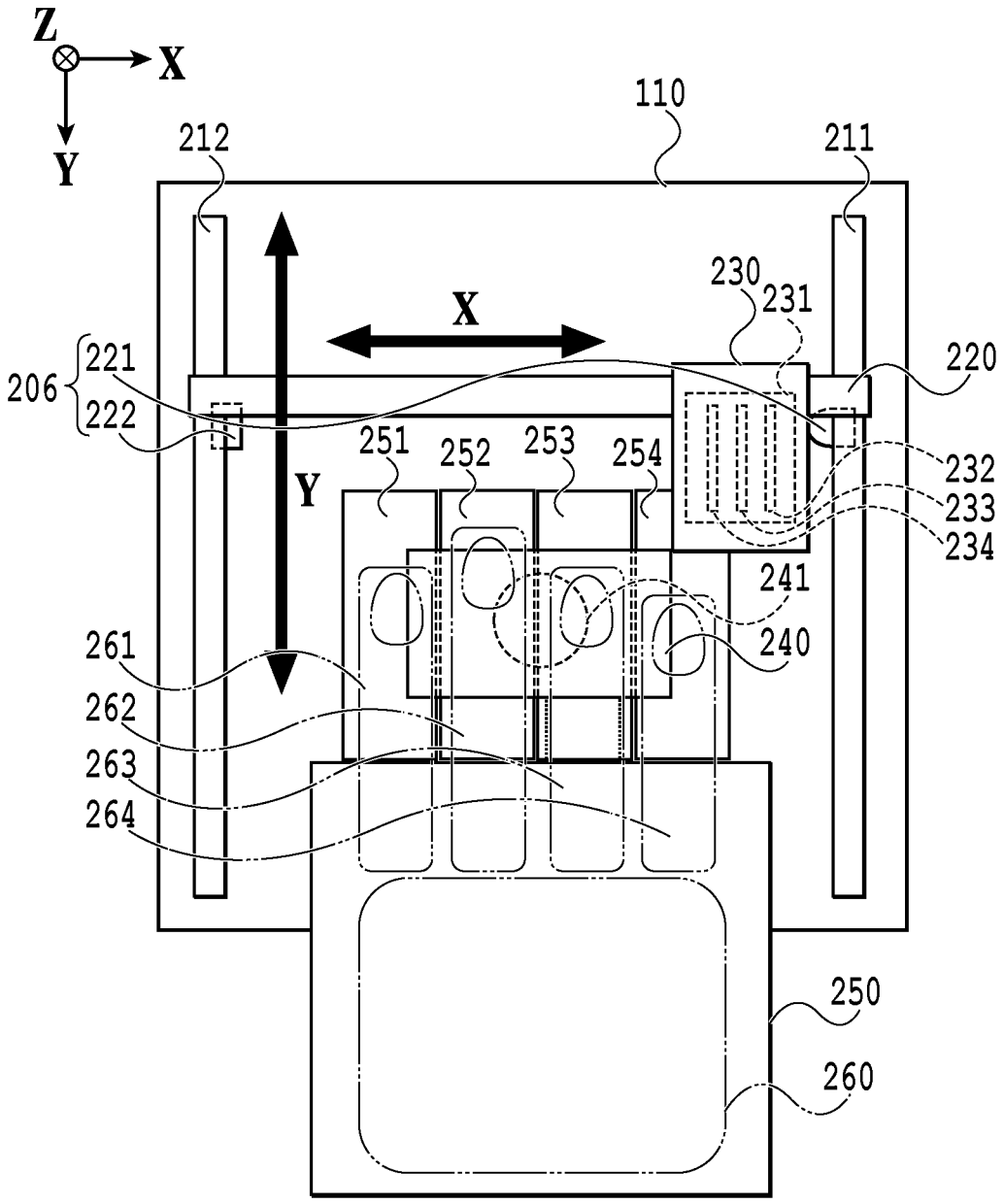
FIG. 2 is a top view illustrating a configuration of a nail printing apparatus.

FIG. 2 is a top view illustrating the configuration of the nail printing apparatus 110 of the present embodiment. FIG. 2 is a diagram schematically illustrating the upper surface of the nail printing apparatus 110 inside the housing. In the present specification, the direction along the X-axis is the left-right direction, the direction along the Y-axis is the front-rear direction, and the direction along the Z-axis which is perpendicular to the X-axis and the Y-axis is the up-down direction. Further, the +Y direction is the front side, the −Y direction is the rear side, the +Z direction is the downward direction, and the −Z direction is the upward direction.

The nail printing apparatus 110 has the Y-direction rail guides 211 and 212 for moving the print head 230 in the front-rear direction. Further, the nail printing apparatus 110 has the X-direction rail guide 220 for moving the print head 230 in the left-right direction, which intersects the front-rear direction.

The heater board 231 is mounted below the print head 230. The following nozzles for ejecting ink are arranged on the heater board 231.

Cyan ink ejection nozzle 232

Magenta ink ejection nozzle 233

Yellow ink ejection nozzle 234

The movement directions in which the print head 230 of the present embodiment can be moved include not only the left-right direction but also the front-rear direction. For example, in a case where the scanning direction is set to the left-right direction, ink is ejected from the ink ejection nozzles 232 to 234 of the respective colors while the print head 230 moves in the left-right direction, so that one scanning and recording operation is performed. Subsequently, by moving the print head 230 in the front-rear direction and then performing the next scanning and recording operation, an image can be printed on a nail. Therefore, in the present embodiment, the image can be printed on the printing target nail while the printing target nail is fixed.

The laser sensor light-emitting unit 221 is installed at one end of the X-direction rail guide 220, and the laser sensor light-receiving unit 222 is installed at the other end of the X-direction rail guide 220. Therefore, the laser sensor light-emitting unit 221 and the laser sensor light-receiving unit 222 are configured to move in the front-rear direction in synchronization with the movement of the print head 230 in the front-rear direction. Further, the laser sensor light-emitting unit 221 and the laser sensor light-receiving unit 222 are installed at positions downwardly distant from the ink ejection nozzles 232 to 234. The laser sensor light-emitting unit 221 emits a laser toward the laser sensor light-receiving unit 222 in the X direction. The laser sensor light-emitting unit 221 and the laser sensor light-receiving unit 222 may be collectively referred to as the laser sensor 206.

On the inner side of the ceiling unit of the nail printing apparatus 110, the camera 240 for capturing an image of a finger is installed. The lens 241 is arranged on the lower side of the camera 240.

On the floor side of the nail printing apparatus 110, the hand rest 250 for placing a palm and the finger rests 251 to 254 for fixing the finger positions are arranged. The nail printing apparatus 110 is capable of performing the control of independently adjusting each position (heights) of the finger rests 251 to 254 in the Z-axis direction. That is, each of the finger rests 251 to 254 is configured to be independently movable in the direction facing the print head 230 which performs printing on the nails.

In FIG. 2, the back 260 and the fingers 261 to 264 of a hand of the person to be printed are schematically illustrated. The fingers of the person to be printed are placed on the finger rests 251 to 254 so as to extend in the front-rear direction. In the example of FIG. 2, the hand of the person to be printed is the right hand. The back 260 of the right hand is placed on the hand rest 250. It is assumed that the index finger 261 of the right hand is placed on the finger rest 251, the middle finger 262 is placed on the finger rest 252, the ring finger 263 is placed on the finger rest 253, and the little finger 264 is placed on the finger rest 254, respectively.

Figure 3:
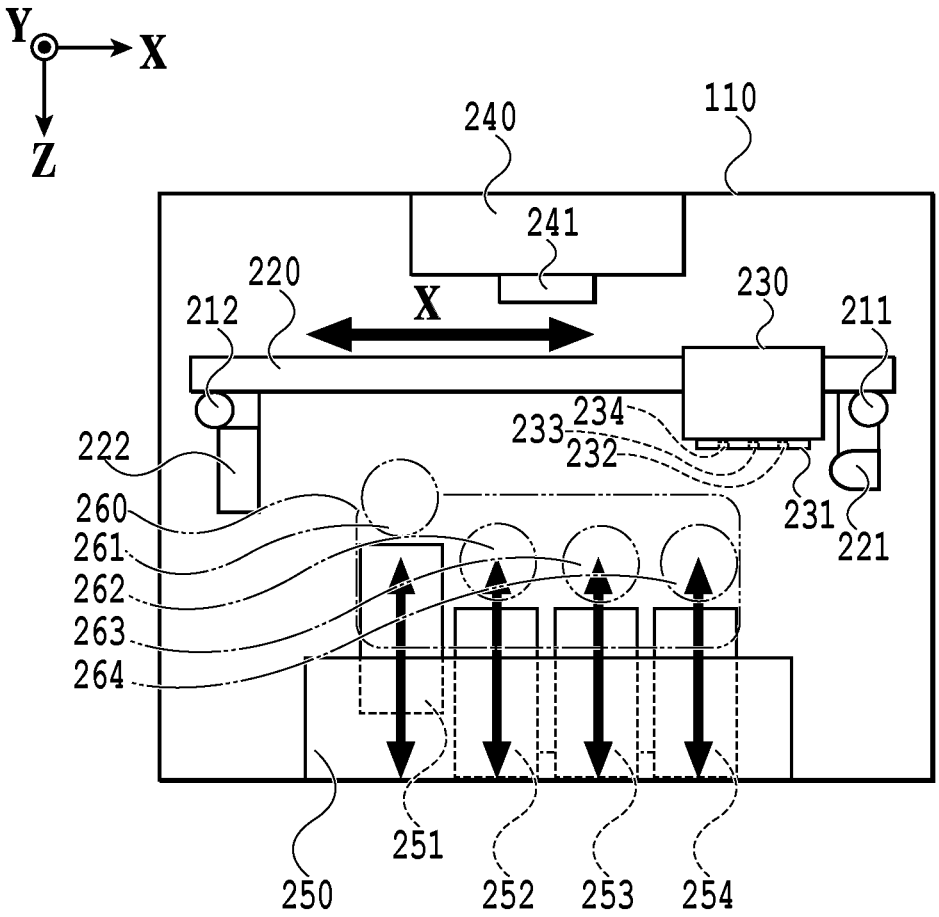
FIG. 3 is a front view illustrating the configuration of the nail printing apparatus.
Figure 4:
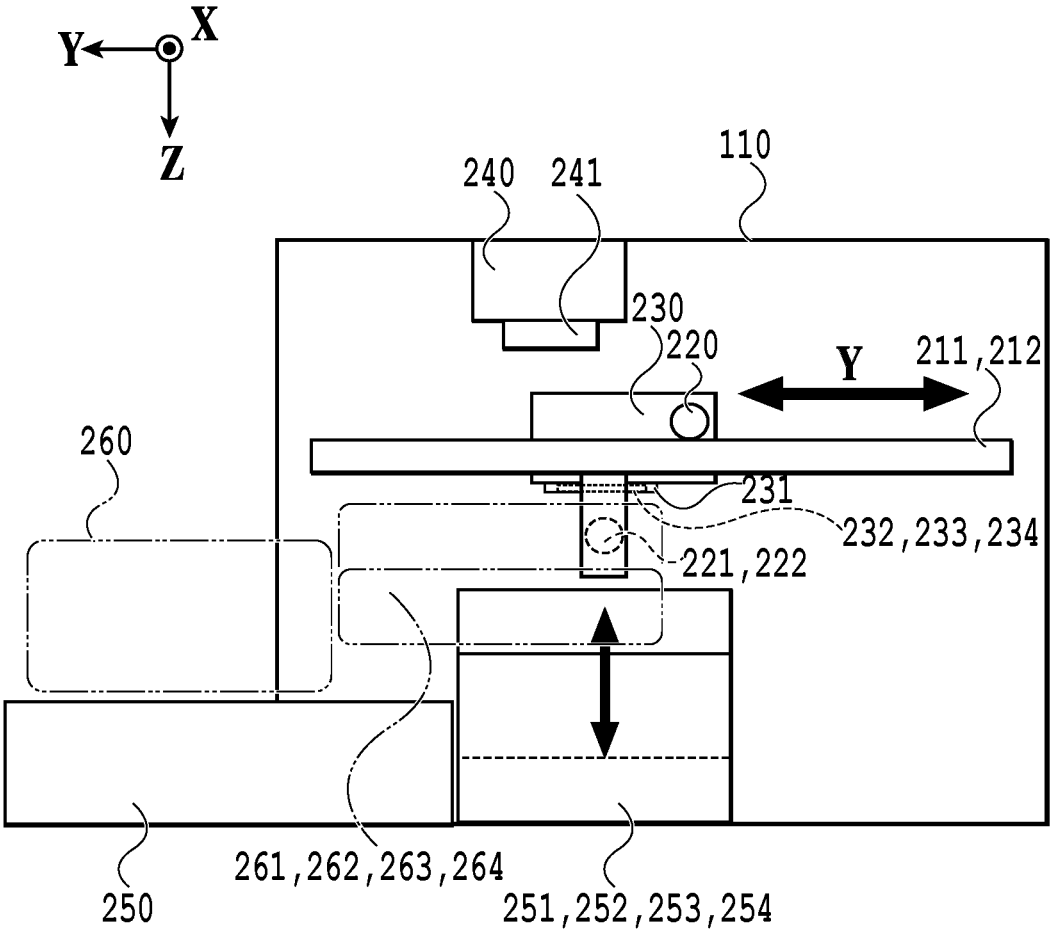
FIG. 4 is a side view illustrating the configuration of the nail printing apparatus.

FIG. 3 is a front view illustrating the configuration of the nail printing apparatus 110 of the present embodiment. FIG. 4 is a side view illustrating the configuration of the nail printing apparatus 110 of the present embodiment. As with FIG. 2, FIG. 3 and FIG. 4 are also diagrams schematically illustrating the nail printing apparatus 110 inside of the housing. The reference signs in FIG. 3 and FIG. 4 indicate the same configurations as in FIG. 2.

[About Height Adjustment of the Finger Rests]

Here, with reference to FIG. 2 to FIG. 4, the height adjustment of the finger rests 251 to 254 will be explained. By adjusting the heights of the finger rests 251 to 254, the positions of the nails in the Z direction relative to the respective ink ejection nozzles 232 to 234 of the print head 230 at the time of printing can be adjusted.

In order to print images of higher definitions on the nails, it is desired that the printing target nails are located at positions where the ink ejected from the respective ink ejection nozzles 232 to 234 can be properly landed. Therefore, by adjusting the heights of the finger rests 251 to 254, the relative distances between the nails and the ink ejection nozzles 232 to 234 in the Z direction are adjusted.

Each of the finger rests 251 to 254 is configured to be independently raised or lowered, and the motor controller 118 is capable of performing the control of adjusting the heights (positions in the Z-axis direction) of the finger rests 251 to 254 independently for each of the finger rests 251 to 254. In the present embodiment, one of the finger rests 251 to 254 is selected, and the height is adjusted for each finger rest that is selected. For example, in a case where the index finger 261, middle finger 262, ring finger 263, and little finger 264 of the right hand are placed on the finger rests 251 to 254, respectively, the heights will be adjusted in order from the finger rest 251, on which the index finger 261 is placed. If the height adjustment of the finger rest 251, on which the index finger 261 is placed, is completed, the finger rest 252 will be selected next and the height adjustment will be similarly performed. This order is an example of the order of the finger rests for height adjustment, and the height may be adjusted from any finger rest.

The movable laser sensor 206 (the laser sensor light-emitting unit 221 and the laser sensor light-receiving unit 222) mounted on the nail printing apparatus 110 is used for adjusting the height of each of the finger rests 251 to 254. In a case where the person to be printed places his or her fingers on the finger rests 251 to 254, the finger rests 251 to 254 are at the positions lowered to the initial positions. In this case, if the laser is emitted from the laser sensor light-emitting unit 221, the emitted laser is not blocked so that the laser sensor light-receiving unit 222 receives the laser. Therefore, at the start of the height adjustment, the laser emitted from the laser sensor light-emitting unit 221 is not blocked and received by the laser sensor light-receiving unit 222.

If the finger rests 251 to 254 continue to be raised, the laser being emitted from the laser sensor light-emitting unit 221 is blocked by a part of the fingers of the person to be printed placed on the finger rests 251 to 254. If it is determined that the laser is blocked and the laser sensor light-receiving unit 222 is not receiving the laser, the motor controller 118 performs the control of stopping raising the finger rests. In this way, the heights of the finger rests 251 to 254 can be adjusted.

The laser sensor light-emitting unit 221 and the laser sensor light-receiving unit 222 are located below the nozzles of the print head 230, and the position in the Z direction of the laser emitted from the laser sensor light-emitting unit 221 is a position where the ink can be properly landed by the print head 230. Therefore, if the raising of the finger rests 251 to 254 can be stopped in response to blocking of the laser with the nails of the fingers placed on the finger rests 251 to 254, the heights of the finger rests 251 to 254 can be adjusted so that the nails will be properly located at the landing position of ink. Therefore, it is preferable that the positions of the laser sensor light-emitting unit 221 and the laser sensor light-receiving unit 222 in the Y direction at the time of performing the height adjustment are the positions where the nail areas of the fingers placed on the finger rests, which are the targets of the height adjustment, are located.

Therefore, in the present embodiment, the nail areas are detected from the captured image of the fingers placed on the finger rests 251 to 254 before the height adjustment of the finger rests 251 to 254 is performed. By appropriately converting the coordinates (X coordinate, Y coordinate) of a nail area in the captured image to the coordinate position in the Y direction in the nail printing apparatus 110, it is possible to move the laser sensor 206 to a position corresponding to the nail area in the Y direction. Therefore, for example, in a case where the finger rest to be the target of the height adjustment is set to the finger rest 251, the laser sensor light-emitting unit 221 and the laser sensor light-receiving unit 222 can be moved in the Y direction to the positions where the nail of the finger placed on the finger rest 251 is located before the finger rest 251 is raised. Thereafter, if the finger rest 251 is raised, the laser is blocked by the nail of the finger placed on the finger rest 251. By raising the finger rest 251 until the laser is blocked, the height of the finger rest 251 can be adjusted so that the height of the nail of the finger placed on the finger rest 251 will be at a proper position. Note that the finger rests 252 to 254, which are not the target of the height adjustment, are controlled in a lowered state so that the laser is not blocked.

[Processing Flow]

Figures 5, 5A:
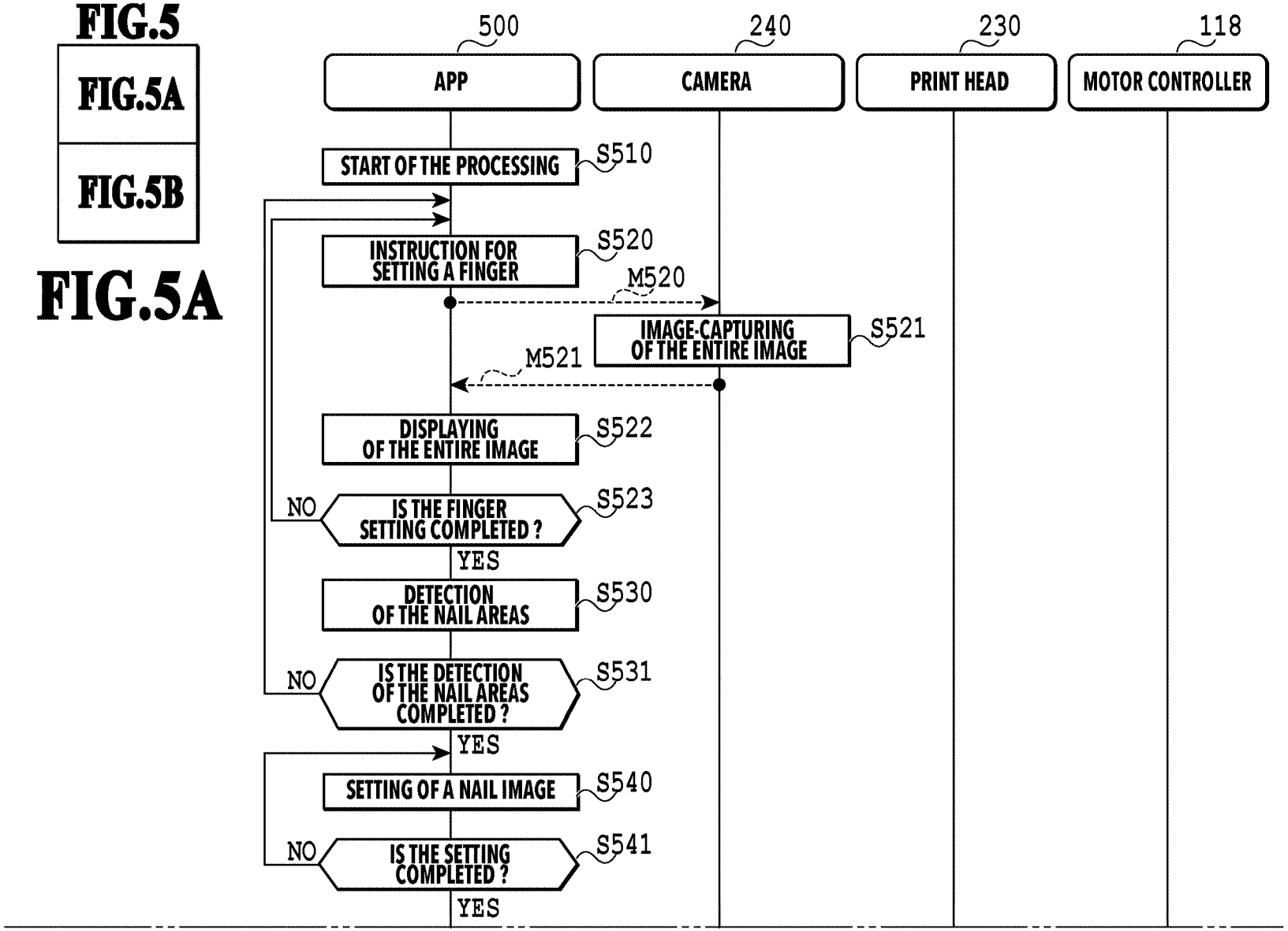
FIG. 5 is a diagram showing the relationship of FIG. 5A and FIG. 5B.
FIG. 5A is a diagram illustrating an example of a processing flow performed in the printing system.
Figure 5B:
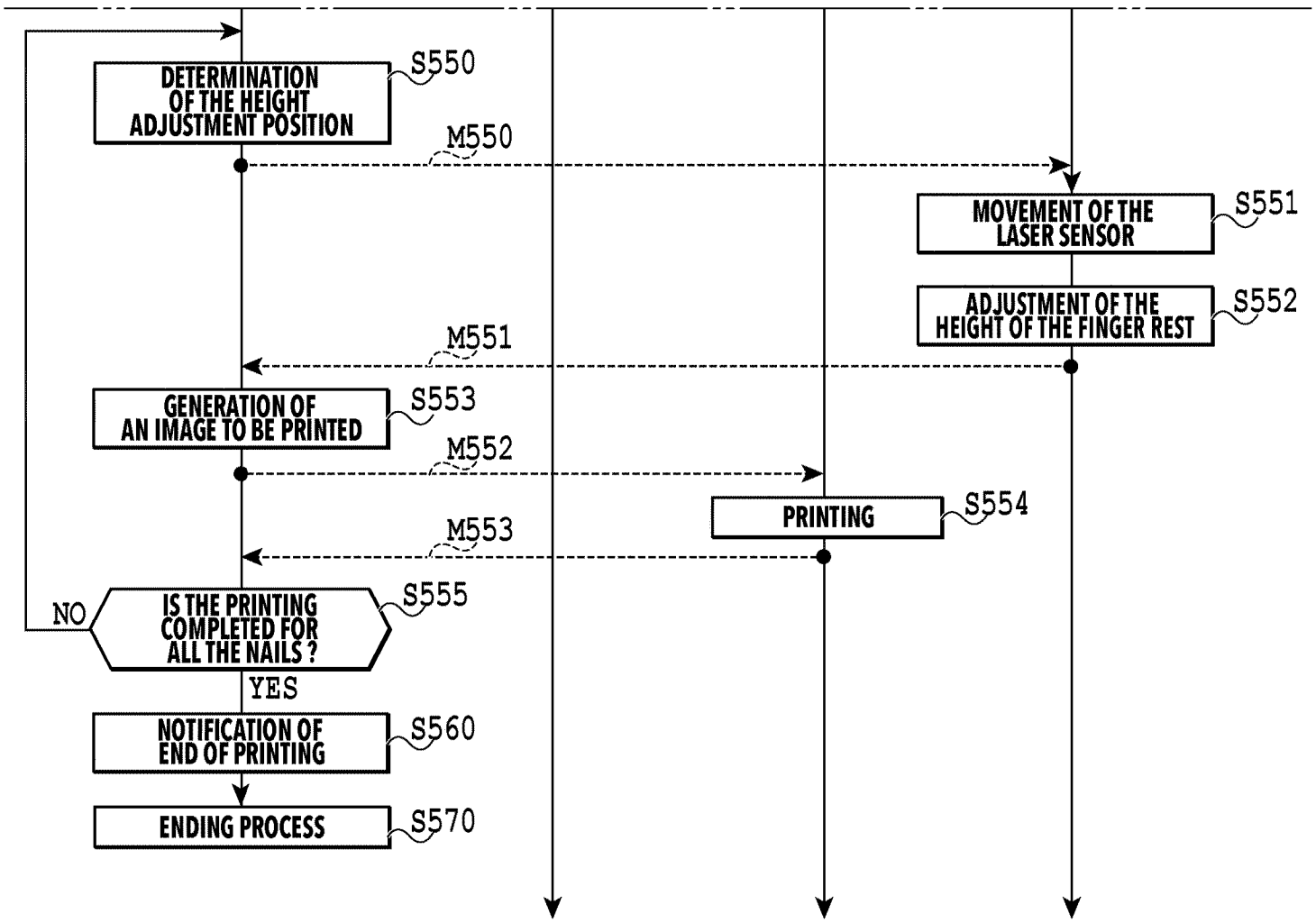
FIG. 5B is a diagram illustrating an example of a processing flow performed in the printing system.

FIG. 5 is a diagram illustrating an example of the processing flow for printing an image on the nails of the fingers placed on the finger rests 251 to 254, which is performed in the printing system of the present embodiment. The app 500 corresponds to processing executed by the host 100 of FIG. 1. That is, the app 500 corresponds to processing performed by a nail app activated by the host 100. The camera 240 captures an image of the fingers and transmits the image data of the captured image to the app 500. The nail printing apparatus 110 obtains an image to be printed, which is to be used for printing on nails, from the app 500, and the print head 230 is controlled by the motor controller 118, the head controller 115, etc., so that printing is performed on the actual nail portions of the fingers of the person to be printed. The motor controller 118 further controls the movement of the laser sensor 206 and controls the raising and lowering of the finger rests 251 to 254. Note that although the user (the person to be printed) on which an image is printed on the nails by the nail printing apparatus 110 and the user who operates the app are explained as the same person, it is also possible that they are different users.

The processing of the app 500 in FIG. 5 is performed by the CPU 101 of the host 100 loading a program code stored in the HDD 103 into the RAM 102 and executing the program code. Alternatively, a part or all of the functions in the steps of FIG. 5 may be implemented by hardware such as an ASIC or an electronic circuit. Note that the symbol "S" in the explanation of each process means that it is a step in the sequence.

In S510, the app 500 starts the processing. For example, the process of S510 is started in response to the user of the app 500 activating the nail app or the like. Further, if necessary, the processes of starting the camera 240, the head controller 115, and the motor controller 118 are also performed.

Next, the finger setting processes are performed in S520 to S523. First, in S520, the app 500 displays a screen for instructing the person to be printed to set his or her hand on the hand rest 250 and the finger rest 251 on the display device 107. The person to be printed places his or her fingers on the finger rests 251 to 254 as explained with reference to FIG. 2. Next, the app 500 outputs the entire image capturing message M520 to the camera 240. Note that, although the example in which four fingers are placed on the finger rests 251 to 254 is illustrated in FIG. 2 to FIG. 4, it is sufficient as long as at least one of the index finger, middle finger, ring finger, and little finger is placed. Further, in a case of performing printing on the thumb nail, only the thumb is placed.

In S521, the camera 240 captures an image of the entire fingers placed on the finger rests 251 to 254 and sends the entire captured image information message M521 to the app 500. The entire captured image information message M521 includes the image data of the entire image acquired by the image-capturing in the present step. For example, in a case where four fingers are placed on the finger rests 251 to 254, the camera 240 captures an image of the four fingers.

In S522, the app 500 obtains the entire image acquired by the image-capturing in S521 and displays the obtained entire image on the display device 107. Further, the app 500 also displays a "finger setting completion button", which is to be pressed by the person to be printed in a case where setting of the fingers is completed, on the display device 107.

In S523, the app 500 determines whether or not the "finger setting completion button" has been pressed. In a case where the person to be printed confirms the entire image and presses the "finger setting completion button", the processing proceeds to S530. If the "finger setting completion button" is not pressed, the processing returns to S520 so that the finger setting processes of S520 to S523 will be executed again.

Next, the nail area detection processes of S530 to S531 are performed. First, in S530, the app 500 analyzes the image data of the entire image of the fingers which is obtained as a result of the image-capturing in S521. Further, the number of nails included in the entire image and the information of each nail area indicating the X position, the Y position, the width in the X direction, the width in the Y direction, and the shape of the nail area are detected. The information of the positions and shapes obtained herein is the positions and shapes of the nail areas in the entire image (that is, a two-dimensional plane). The X direction is the direction along the longitudinal direction of the X-direction rail guide 220 in FIG. 2, and the Y direction is the direction along the longitudinal direction of the Y-direction rail guides 211 and 212 in FIG. 2.

The positions and shapes of the nail areas of the actual person to be printed are determined from the captured image since the positions and shapes of nails differ depending on the person to be printed. Further, the positions and shapes of the nail areas of the actual person to be printed are determined so as to print an image according to the actual positions and shapes of the nails.

As one method of detecting a nail area, there is a method of detecting the white color of the base coat applied to a nail by image processing. Specifically, pixels exceeding a predetermined threshold value (for example, R>200, G>200, B>200) are detected from the RGB values of the captured image, and the detected area is determined as a nail area. In order not to erroneously detect the finger rests 251 to 254 beneath the fingers as the nails in the nail detection, it is preferable that the color of the finger rests 251 to 254 is black or the like other than white. Further, it is desirable that the finger rests 251 to 254 are configured of a material that diffusely reflects light, so that a white area part in the captured image caused by the reflection of light is not erroneously detected as a nail area. Alternatively, it is also possible to perform edge detection processing on the captured image so that a nail area is detected by use of the information acquired as a result thereof. Alternatively, since the detection by image processing is difficult in a case where the base coat is translucent, it is also possible to use machine learning as another detection method. By using an image of a nail coated with a white or translucent base coat as an image to be a learning target in the machine learning, it is possible to detect a nail area even in a case of a translucent base coat, not only a white base coat. In the machine learning, a learning model is established by learning where in a prepared learning image a nail is located. The established learning model is incorporated in the app 500, processed by the CPU 101, and utilized to detect a nail area from a captured image. Since the color of the skin and the shape of a nail vary depending on the person, it is preferable that many hand patterns are prepared as the learning images for learning. There are many frameworks for machine learning, and machine learning can be implemented by utilizing existing frameworks.

In S531, the app 500 determines whether or not the nail areas are correctly detected. In a case where it is determined that the nail areas are correctly detected, the processing proceeds to S540, and, in a case where it is determined that the nail areas are not detected correctly, the processing returns to S520, so that the finger setting processes and the nail area detection processes will be repeated.

As the method for determining whether the nail areas are correctly detected, it is determined that the nail areas are correctly detected in a case where the following conditions are satisfied, for example. It will be determined that the positions and shapes of the nail areas have been detected correctly in a case where: the number of detected nail areas is 4; the nail areas exist at approximately equal intervals in the X coordinates; the nail of the middle finger is located on the rear side in the Y direction; and the nail of the little finger is located on the front side in the Y direction. On the other hand, it will be determined that the nail areas have not been detected correctly in a case where the number of obtained nail areas is 0 or more than 5, in a case where multiple nails are detected at almost the same X position, etc. In other cases, such as in a case where the number of obtained nail areas is 1 to 3, it is also possible to exclude undetected nails of fingers from the printing targets or register the positions and shapes of standard nail areas for the undetected nails of fingers, so as to proceed the processing to S540.

Next, the app 500 performs the nail image setting processes in S540 to S541. First, in S540, the app 500 displays information indicating that the nail image setting processes will be performed on the display device 107 for the person to be printed. Further, the app 500 also displays a "nail image setting completion button", which is to be pressed if the setting of nail images is completed.

As a result of this S540, the person to be printed at least selects "an image design to be printed on a nail". That is, the person to be printed selects a design to be printed on a nail through the display device I/F 106.

Figure 6B:
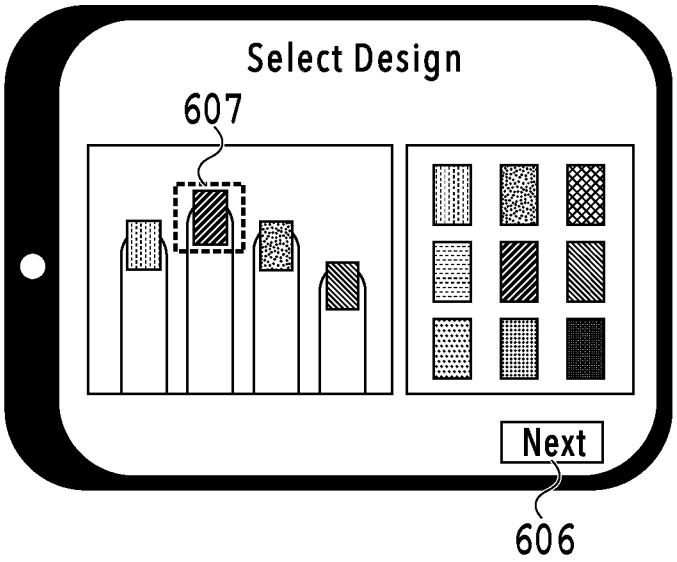
FIG. 6A and FIG. 6B are diagrams illustrating an example of a design selection screen displayed on a display device.
Figure 6A:
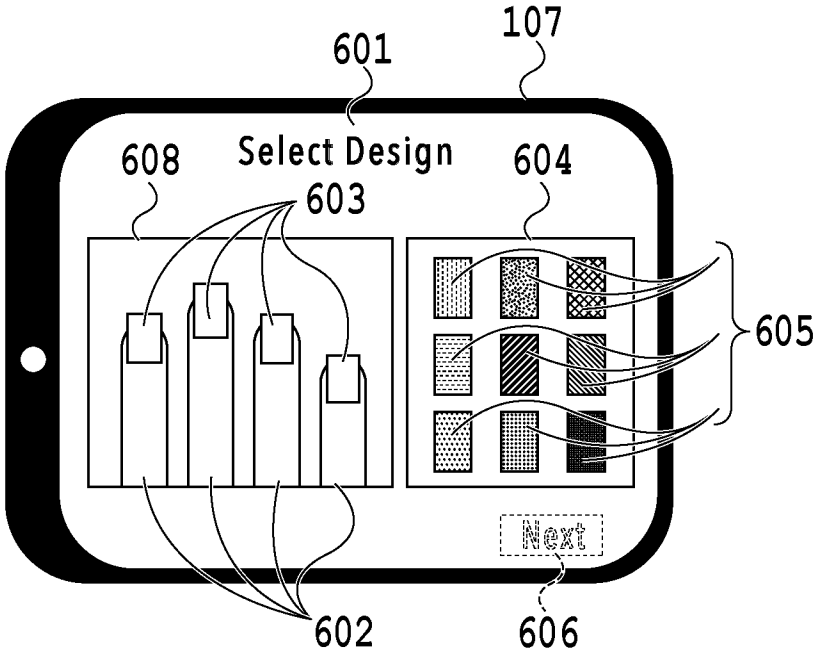

FIG. 6A and FIG. 6B are diagrams illustrating an example of the design selection screen 601 displayed on the display device 107. FIG. 6A is an example of a screen in a case where the designs have not been set, and FIG. 6B is an example of a screen in a case where the designs have been set. On the selection screen 601 of FIG. 6A, the finger models 602 and the nail models 603 are displayed. On the selection screen 601, the person to be printed selects which design is set for which nail of fingers. Note that, although the example in which the person who executes the design selection and the person to be printed are the same will be used in the present embodiment, it is also possible that they are different in a case of use in a nail salon or the like, for example.

The person to be printed selects a design to be used for printing on a nail from the design list 604 displayed on the selection screen 601. The design list 604 includes respective design images 605. Each design image 605 included in the design list 604 may be saved in advance in the HDD 103 in the host 100 or may be obtained from a network by use of the data transfer I/F 104. In a case where the person to be printed selects a design, a given one of the nail models 603 will be pressed first. The pressed nail model 603 will be in a selected state, and, as illustrated in FIG. 6B, the frame line 607 indicative of being selected will be displayed. By pressing each design image 605 included in the design list 604 in this state, the pressed design image 605 will be set for the nail model 603 that is in the selected state.

The nail image setting completion button 606 is a button for transitioning to the next step. The processing will be proceeded by pressing the nail image setting completion button 606 after selecting a design. Note that, in a case where no design image is selected, the nail image setting completion button 606 is grayed out and disabled as illustrated in FIG. 6A. The nail image setting completion button 606 will not be in such an abled state as illustrated in FIG. 6B until at least one design image is set.

In S541, the app 500 determines whether or not the person to be printed presses the nail image setting completion button 606. In a case where the determination result is No, the processing returns to S540 to continue the nail image setting processes, and, in a case where the determination result is Yes, the processing proceeds to S550. By repeating the series of processing flow of these S540 to S541 on a real time basis, the person to be printed can easily set an image for a nail area.

Next, in S550 to S555, the processes for performing printing on a nail of the person to be printed are performed. The subsequent steps S550 to S554 are performed for each printing target nail, and the processes of S550 to S554 are repeated as many times as the number of nails on which a nail image will be printed. For example, in a case where the four nails from the index finger to the little finger of the right hand are to be the printing targets, the height adjustment and image printing on a nail are performed for each finger and, if the print processing ends, the processes will be repeated for the next nail. In the following explanation, the processes of S550 to S554 will be explained with the example in a case where the four fingers from the index finger to the little finger of the right hand of the person to be printed are placed on the finger rests 251 to 254 as a result of S520 and the index finger placed on the finger rest 251 is selected as the finger of the printing target.

In S550, the app 500 detects the position of the rear tip (on the fingertip side) of the nail area of the finger of the printing target in the Y direction, based on the position and shape of the nail area detected in S530. The detected position is determined as the "adjustment position" of the finger of the printing target. Further, the app 500 outputs the height adjustment message M550, which includes the position information of the determined adjustment position, to the nail printing apparatus 110.

In S551, the motor controller 118 moves the laser sensor light-emitting unit 221 so that the position of the laser sensor light-emitting unit 221 in the Y direction will be located at the adjustment position, which is included in the height adjustment message M550, in the Y direction. That is, the laser sensor light-emitting unit 221 is moved so that the optical axis of the laser, which corresponds to the detection range of the laser sensor light-emitting unit 221, is included in the adjustment position on the XY plane. The laser sensor light-receiving unit 222 also moves in accordance with the movement of the laser sensor light-emitting unit 221.

In S552, the motor controller 118 performs a process of raising the finger rest 251, on which the finger of the printing target is placed. If the finger rest 251 rises, the laser emitted from the laser sensor light-emitting unit 221 is blocked by the nail of the finger that is the printing target. If it is determined that the state where the laser sensor light-receiving unit 222 is receiving the laser is changed to the state where the laser sensor light-receiving unit 222 is not receiving the laser, the raising of the finger rest 251 will be stopped, and the height adjustment of the finger rest 251 on which the finger of the printing target is placed will end. If the height adjustment is completed, the nail printing apparatus 110 sends the height adjustment completion message M551 to the app 500. Since there is a possibility that the fingers placed on the finger rests 252 to 254 block the laser, the finger rests 252 to 254 for the fingers that are not the print targets are controlled so as to be kept in the lowered state.

Note that, although the tip of a nail is explained as the adjustment position in the present embodiment, it is also possible that the adjustment position is determined according to the configuration of the finger rests 251 to 254, the configuration of the laser sensor 206, the shapes of the fingers, etc. That is, the adjustment position may not be the tip of a nail. Further, although the adjustment position is explained as one point at the tip of a nail, it is also possible that, not one point, but multiple positions within a nail area are designated as the adjustment positions, so that the height adjustment will be performed based on the designated positions. For example, in a case of designating multiple positions in a nail area, the laser sensor light-emitting unit 221 is moved to the respective positions in the Y direction corresponding to the designated positions, so that the average height of the finger rest 251 at the time where the laser is blocked is set as the adjusted height of the finger rest 251.

In S553, the app 500 performs a process of generating an image to be printed, which will be used for the print processing on the nail. The image to be printed is an image which includes an image area (printing area) for landing a recording material on the nail area of the finger of the printing target and in which a desired nail image is assigned to the image area thereof. For example, an image to be printed is generated by setting an image area for printing a nail image, based on the nail areas detected from the entire image, and reflecting the nail image data which is set in S540 to the image area. Then, the app 500 displays information indicating "printing will be started" on the display device 107 and outputs the print message M552 including the image data of the generated image to be printed to the nail printing apparatus 110. As described above, in the present embodiment, the explanation will be given on the assumption that the image to be printed is generated based on the entire image which is obtained by the image-capturing in S521.

Note that, although the step of S553 was explained as a step after determining the height adjustment position in S550 for convenience of explanation, it is also possible to be performed in parallel with other processes after the setting of the nail image is completed in S541. In that case, it is also possible that the generated image to be printed on the nail of the finger that is the printing target is obtained in S553 and the print message M552 including the image data of the obtained image to be printed is output to the nail printing apparatus 110.

In S554, the print head 230 is controlled to perform printing on the nail of the finger that is the printing target by using the image data of the image to be printed, which is output from the app 500, as the recording data. The finger rest 251 on which the finger that is the printing target is placed is controlled to be at a position of which the height has been adjusted to be higher than the height of the hand rest 250. In a case where printing is completed, the nail printing apparatus 110 sends the message M553 including print completion information to the app 500.

In S555, the app 500 determines whether printing is completed for the number of nails detected in S530. In a case where the printing is completed for all nails, the processing proceeds to S560. In a case where the printing is not completed for all nails, the finger of the next printing target will be selected and the processes of S550 to S554 will be repeated until the printing is completed for the nails of all fingers. Note that it is also possible that the app 500 determines the height adjustment position of the unprinted fingers other than the printing target while the nail printing apparatus 110 is performing the height adjustment of S552 and the print processing of S554 for the finger that is the printing target.

In S560, the app 500 displays information indicating "printing is completed" on the display device 107. Finally, in S570, the app 500 performs an ending process to end the processing. If necessary, the processes of ending the camera 240, the head controller 115, and the motor controller 118 are also performed. The above is the explanation of a series of processes performed by the app 500 and the nail printing apparatus 110.

As explained above, according to the present embodiment, the height of a nail can be adjusted according to the finger of a printing target nail. Further, in order to adjust the position of the printing target nail so as to be in a position suitable for printing, it is conceivable to use multiple sensors so as to be able to attend to various nails of the person to be printed. On the other hand, in the present embodiment, it is possible to adjust the height of the printing target nail without using multiple sensors. Therefore, according to the present embodiment, it is possible to suppress an increase in cost as compared with a form using multiple sensors. Further, such a configuration in which the height adjustment is performed by repeating moving a sensor and moving a finger rest multiple times is also conceivable. On the other hand, in the present embodiment, the position of the sensor for adjusting the height can be determined from the image of the fingers obtained by the camera installed in the printing apparatus. Therefore, according to the present embodiment, the time period required for height adjustment can be shortened.

Note that the adjustment position does not have to be determined from the nail areas detected based on the captured image. Alternatively, for example, it is also possible that the adjustment position is determined for each finger in advance and the determined adjustment position is obtained according to the type of the finger to be the printing target. Alternatively, it is also possible to determine the adjustment position based on the past print information.

Second Embodiment

In the first embodiment, the method of adjusting the height of a finger rest once is explained. In the present embodiment, the method of capturing an image of a nail placed on a finger rest of which the height has been adjusted and performing height adjustment again based on the captured image acquired by the image-capturing will be explained. Further, in the present embodiment, the method of generating an image to be printed, based on the captured image of the finger placed on the finger rest of which the height has been adjusted, will be explained. In the present embodiment, the differences from the first embodiment will be mainly explained. Not-specified parts have the same configurations and processing as those in the first embodiment.

Figures 7, 7A:
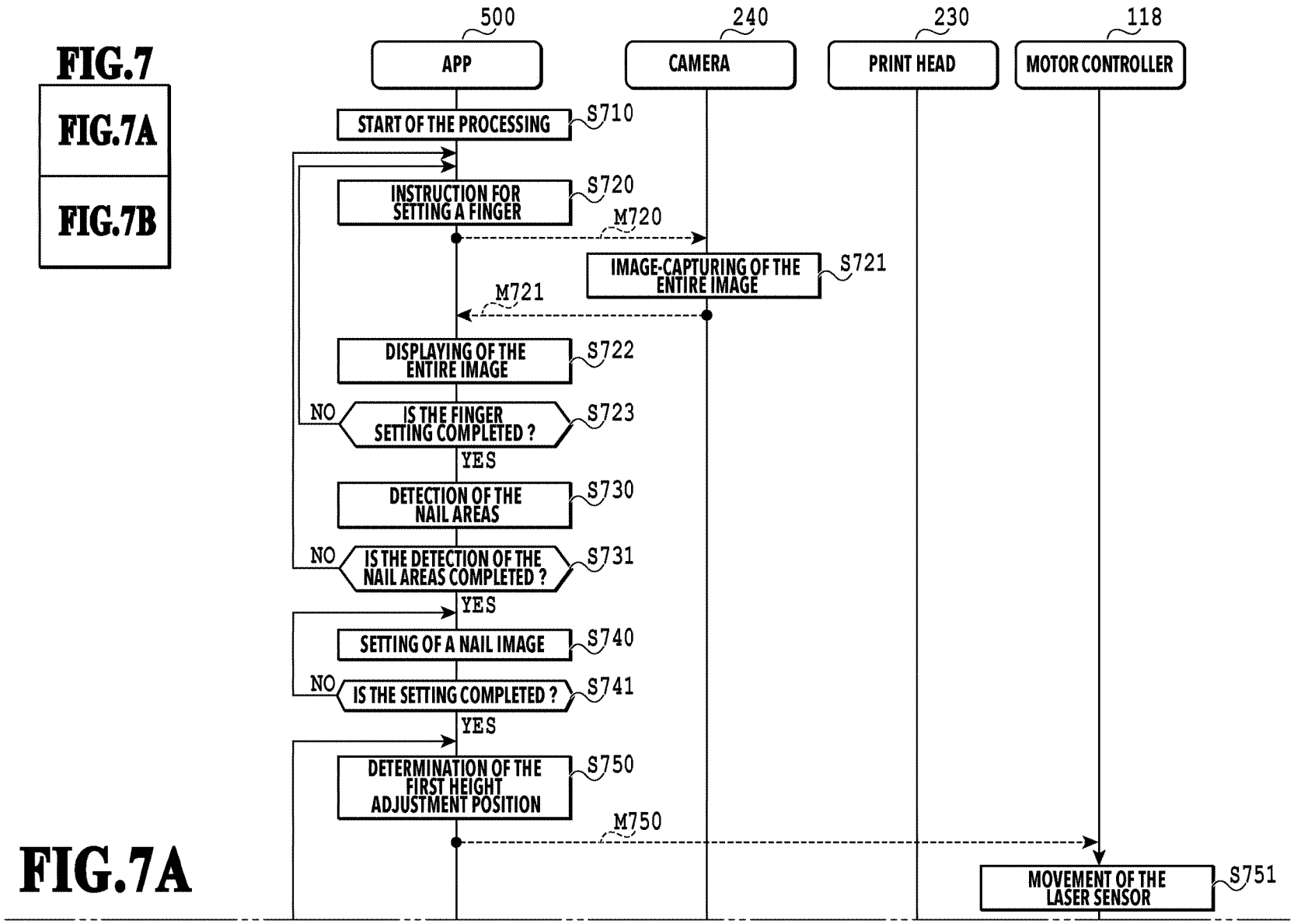
FIG. 7 is a diagram showing the relationship of FIG. 7A and FIG. 7B.
FIG. 7A is a diagram illustrating an example of a processing flow performed in the printing system.
Figure 7B:
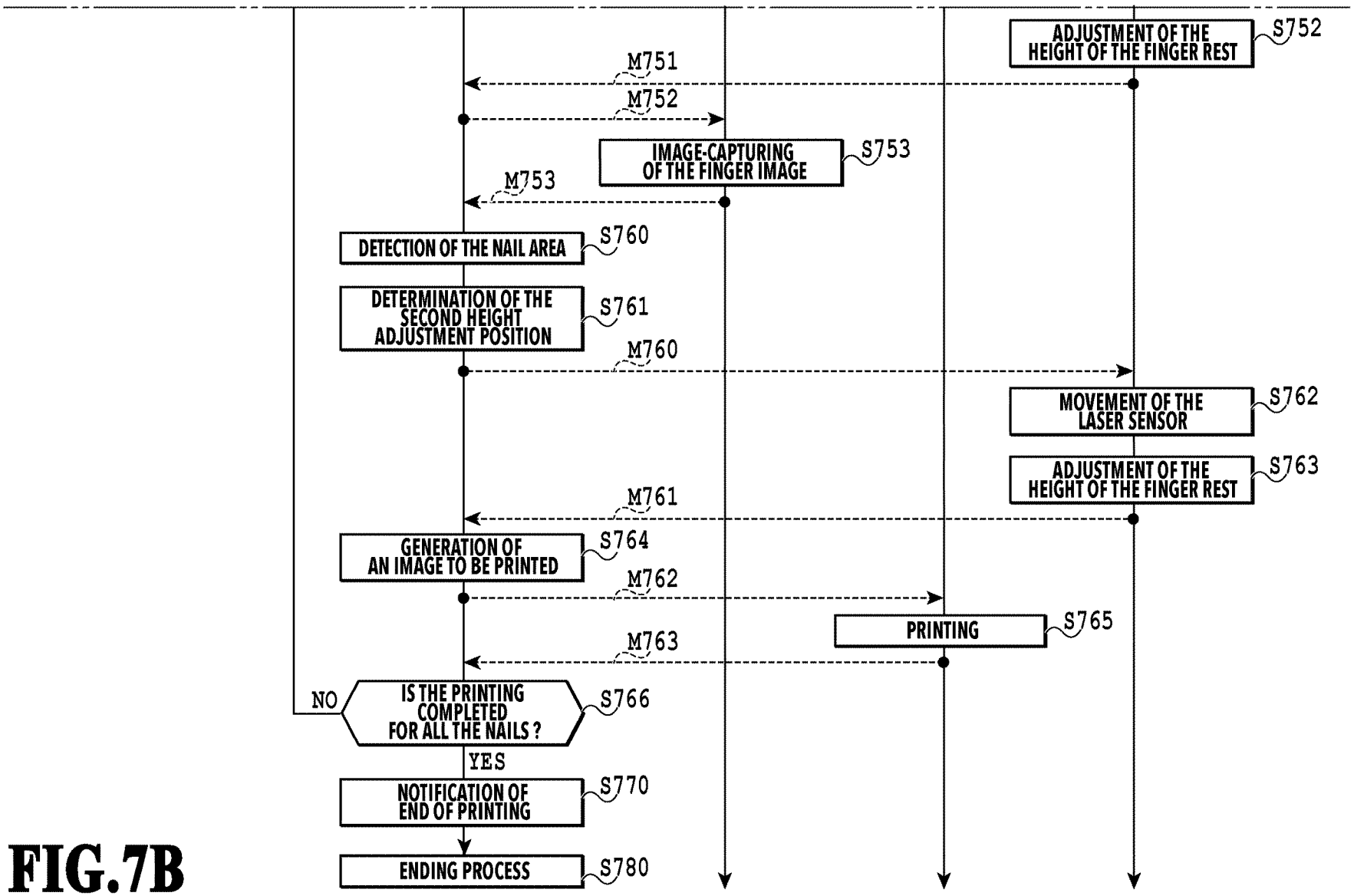
FIG. 7B is a diagram illustrating an example of a processing flow performed in the printing system.

FIG. 7 is a diagram illustrating an example of the processing flow for printing an image on the nails of the fingers placed on the finger rests 251 to 254, which is performed in the printing system of the present embodiment.

S710 is the same process as S510, and the app 500 starts the processing. Further, if necessary, the processes of starting the camera 240, the head controller 115, and the motor controller 118 are also performed. S720 to S722 are finger setting processes. Since S720 to S722 are the same processes as S520 to S522 and M720 to M721 are the same messages as M520 to M521, the explanations thereof will be omitted. Since the nail area detection processes in S730 to S731 are the same processes as S530 to S531, the explanations thereof will be omitted. Since the nail image setting processes in S740 to S741 are the same processes as S540 to S541, the explanations thereof will be omitted.

S750 to S753 are processes for selecting one finger rest and adjusting the height. The height adjustment processes of S750 to S753 are performed for each finger rest that is selected as the adjustment target from the finger rests 251 to 254, and the processes of S750 to S753 are repeated as many times as the number of finger rests on which the fingers are placed. In the following explanation, it is assumed that the finger rest of the adjustment target is the finger rest 251.

S750 to S752 are the same processes as S550 to S552. That is, in S750, the app 500 determines the "first adjustment position" of the finger rest 251, which is the adjustment target, from the positions and shapes of the nail areas which are detected based on the entire image acquired by the image-capturing of S721. Further, the first height adjustment message M750, which includes the position information of the determined first adjustment position, is output to the nail printing apparatus 110. Although the "first adjustment position" is, for example, the position of the tip of a nail area on the rear side (fingertip side) in the Y direction of the finger placed on the finger rest 251 of the adjustment target, the first adjustment position is not limited to the tip of a nail area as with the adjustment position in the first embodiment.

In S751, the motor controller 118 moves the laser sensor light-emitting unit 221 so that the position of the laser sensor light-emitting unit 221 in the Y direction will be at the position in the Y direction corresponding to the received first adjustment position.

In S752, the motor controller 118 performs the height adjustment of the finger rest 251 that is the adjustment target. The height adjustment in the present step is referred to as the first height adjustment. If the finger rest 251 which is the adjustment target is raised and it is determined that the state in which the laser sensor light-receiving unit 222 is receiving the laser has been changed to the state in which the laser sensor light-receiving unit 222 is not receiving the laser, the raising of the finger rest 251 which is the adjustment target will be stopped. If the height adjustment is completed, the first height adjustment completion message M751 is output to the app 500. Since there is a possibility that the fingers placed on the finger rests 252 to 254 block the laser, the finger rests 252 to 254 which are not the adjustment target will be kept being in the lowered state.

Upon receiving the first height adjustment completion message M751, the app 500 outputs the finger image capturing message M752 to the camera 240 as an instruction for capturing an image of the nail of the finger placed on the finger rest 251 for which the first height adjustment has been performed.

In S753, the camera 240 captures an image of the nail of the finger placed on the finger rest 251, which is the adjustment target and is at the position for which the first height adjustment has been performed, and, after the image-capturing is completed, the finger image capturing information message M753 in which the captured image data is included is output to the app 500.

Next, the image printing processes on a nail are performed in S760 to S766. The steps S760 to S765 are performed for each nail of the fingers placed on the finger rests 251 to 254, and the processes of S760 to S765 are repeated as many times as the number of nails on which a nail image will be printed. In the present embodiment, the explanation is given on the assumption that the finger rest of the adjustment target, which is selected for the processes of S750 to S753, is directly selected as the printing target of S760 to S765. Alternatively, it is also possible that the processing proceeds to S760 after performing the processes of S750 to 753 for all the finger rests 251 to 254 and then the finger rest of the printing target is selected again in S760. In the following explanation, the case in which the finger rest 251 is selected as the finger rest of the printing target will be explained as an example.

In S760, the app 500 detects the nail area, based on the captured image acquired as a result of the image-capturing in S753. That is, in the present step, the nail area of the finger of the printing target is detected based on the image acquired by capturing an image of the finger placed on the finger rest 251, which is located at a position for which the first height adjustment has been performed. The detection method is the same as S730.

In S761, the app 500 determines the "second adjustment position" of the finger of the printing target, based on the nail area detected in S760. Further, the second height adjustment message M760, which includes the position information of the determined second adjustment position, is output to the nail printing apparatus 110. The method for determining the "second adjustment position" is the same as the determination method for the "first adjustment position". For example, the "second adjustment position" is set to the position of the tip in the Y direction of the nail area detected in S760.

In S762, the motor controller 118 moves the laser sensor light-emitting unit 221 to the received second adjustment position. In a case where the position in the Y direction of the second adjustment position notified by the second height adjustment message M760 is the same as the position in the Y direction of the first height adjustment position notified by the first height adjustment message M750, the laser sensor light-emitting unit 221 need not be moved in S762. In this case, the present step will be skipped.

In S763, the motor controller 118 performs the height adjustment of the finger rest 251 of the printing target. The height adjustment in the present step is referred to as the second height adjustment. If the finger rest 251 of the printing target is raised by the motor controller 118 and it is determined that the state in which the laser sensor light-receiving unit 222 is receiving the laser has been changed to the state in which the laser sensor light-receiving unit 222 is not receiving the laser, the raising of the finger rest 251 of the printing target will be stopped.

The nail of the finger placed on the finger rest 251 for which the first height adjustment has been performed is placed at a position closer to the camera 240 as compared to the position of the nail at the time of the image-capturing of S721. The nail detection accuracy is higher if the nail detection is performed based on a captured image acquired by capturing an image of a nail at a position closer to the camera 240. Therefore, the nail area detected in S760 has higher accuracy than the nail area detected in S730. Therefore, it is possible to perform the height adjustment of the finger rest 251 with higher accuracy before printing, based on the second adjustment position which is determined based on the highly accurate nail area.

Since there is a possibility that the fingers placed on the finger rests 252 to 254 block the laser, the finger rests 252 to 254 which are not the printing target will be kept in the lowered state. If the second height adjustment is completed, the second height adjustment completion message M761 is output to the app 500.

In S764, the app 500 generates an image to be printed on a nail. In the present embodiment, the app 500 determines the image area, based on the nail area of the captured image of the finger placed on the finger rest 251 for which the first height adjustment has been performed. Further, the image to be printed is generated by setting a nail image in the image area. The position of the nail of the finger placed on the finger rest 251 after the first height adjustment is a position close to the height after the second height adjustment, which is the height at which printing is actually performed. Therefore, in the present embodiment, since the image to be printed can be generated from a captured image that is acquired by capturing an image of a nail that is placed at a position close to the height at which printing is actually performed, it is possible to generate the image to be printed with which printing with higher accuracy can be performed.

Then, the app 500 displays information indicating "printing will be started" on the display device 107 and outputs the print message M762 including the image data of the generated image to be printed to the nail printing apparatus 110.

In S765, the print head 230 is controlled so as to perform printing on the nail of the finger that is the printing target by using the received image data of the image to be printed as the recording data. In a case where printing is completed, the nail printing apparatus 110 sends the message M763 including print completion information to the app 500.

In S766, the app 500 determines whether printing is completed for the number of nails detected in S730. In a case where the printing is completed for all nails, the processing proceeds to S770. In a case where printing is not completed for all nails, the finger rest that is the next adjustment target is selected, and the processes of S750 to S765 will be repeated until printing is completed for all nails. Since S770 to S780 are the same as S560 to 570, the explanations thereof will be omitted.

Note that, in the present embodiment, the explanation was given on the premise that one finger rest is selected as the adjustment target from the finger rests 251 to 254, and, after the height of the selected finger rest is adjusted, image-capturing of the finger that is placed on the finger rest at the height-adjusted position is performed in S753. Alternatively, it is also possible that all the finger rests 251 to 254 are located at height-adjusted positions, so as to perform image-capturing of all the fingers that are placed on the height-adjusted finger rests 251 to 254 in S753. For example, in S752, the heights of all the finger rests 251 to 254 are adjusted first. Here, the heights of the respective finger rests at the time where the laser is blocked by the raised finger rests 251 to 254 are stored. Then, before the image-capturing of S753, the heights of the finger rests 251 to 254 may be raised to the height-adjusted positions that are stored, respectively, so that the camera 240 then captures an entire image of the fingers.

As explained above, according to the present embodiment, printing on a nail can be performed with higher accuracy by calculating the height adjustment position of each finger from a captured image of the finger placed on a height-adjusted finger rest.

According to the technique of the present disclosure, the height of a printing target nail can be adjusted according to the printing target nail.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-053238 filed Mar. 26, 2021, which is hereby incorporated by reference herein in its entirety.

What is claimed is:

1. A nail printing apparatus comprising:

a print head that prints an image on a nail of a person to be printed;

a finger rest that is a rest on which a finger of the person to be printed is placed and that is movable in a height direction, the height direction being a direction facing the print head in a case where printing is performed on the nail;

a sensor that is arranged at a position above the finger rest in the height direction as well as below the print head in the height direction, and that is movable in a movement direction and capable of detecting a nail within a detection range, the movement direction being a direction intersecting the height direction; and a control unit configured to perform control of height adjustment in which the sensor is moved in the movement direction so that a first position of a nail area is included in the detection range of the sensor and then the finger rest is moved upward until the sensor detects the nail, the first position the of the nail area being detected based on a captured image of the finger placed on the finger rest.

2. The nail printing apparatus according to claim 1, wherein the control unit controls the sensor to move so that a second position of the nail area is included in the detection range of the sensor and then controls the finger rest to move upward until the sensor detects the nail of the finger placed on the finger rest, the second position being detected based on the captured image of the finger placed on the finger rest for which the height adjustment has been performed.

3. The nail printing apparatus according to claim 2, wherein, in a case where the first position and the second position are the same position, the control unit controls the finger rest to move upward after the height adjustment until the sensor detects the nail of the finger placed on the finger rest without moving the sensor.

4. The nail printing apparatus according to claim 1, wherein the first position is a position of a tip of the nail area.

5. The nail printing apparatus according to claim 1, wherein the movement direction in which the sensor moves is a direction in which the finger placed on the finger rest extends, and wherein the detection range of the sensor is a range located in a direction perpendicular to the direction in which the finger placed on the finger rest extends and to the height direction.

6. The nail printing apparatus according to claim 1, wherein there are a plurality of the finger rests and each of the plurality of the finger rests is configured to be independently movable in the height direction.

7. The nail printing apparatus according to claim 6, wherein, in a case where the height adjustment is executed for one of the plurality of the finger rests, the finger rests that are not targets of the height adjustment are in a state moved downward.

8. The nail printing apparatus according to claim 6, wherein the control unit executes control of the height adjustment of a first finger rest of the plurality of the finger rests based on the captured image and then executes control of the height adjustment of a second finger rest of the plurality of the finger rests based on the captured image, the second finger rest being different from the first finger rest.

9. The nail printing apparatus according to claim 1, wherein the print head performs printing on the nail of the person to be printed based on an image to be printed, the image to be printed being generated based on the captured image of the finger placed on the finger rest for which the height adjustment has been performed.

10. The nail printing apparatus according to claim 1, wherein the print head is an inkjet head.

11. The nail printing apparatus according to claim 1, wherein the printing apparatus comprises a mechanism for moving the finger rest in the height direction.

12. The nail printing apparatus according to claim 1 further comprising a hand rest which is a rest on which a palm of the person to be printed is placed, and wherein the height of the finger rest on which the finger of the nail to be printed by the print head is placed is higher than the height of the hand rest.

13. A nail printing apparatus comprising:

a print head that prints an image on a nail of a person to be printed;

a plurality of finger rests that are rests on which fingers of the person to be printed are placed and that are movable in a height direction, the height direction being a direction facing the print head in a case where printing is performed on the nail, wherein each of the plurality of finger rests can be independently moved in the height direction so that height adjustment is performed for each of the finger rests;

an image-capturing unit configured to capture an image of the fingers placed on the finger rests before the height adjustment; and a sensor that is arranged at a position above the plurality of finger rests in the height direction as well as below the print head in the height direction and that is movable in a movement direction and that is capable of detecting a nail within a detection range, the movement direction being a direction intersecting the height direction.

14. The nail printing apparatus according to claim 13 further comprising a control unit configured to perform control of the height adjustment in which the sensor is moved in the movement direction so that a first position of a nail area is included in the detection range of the sensor and then the finger rest is moved upward until the sensor detects the nail, the nail area being detected based on a captured image of the finger placed on the finger rest.

15. A control method of a nail printing apparatus, the nail printing apparatus comprising:

a print head that prints an image on a nail of a person to be printed;

a finger rest that is a rest on which a finger of the person to be printed is placed and that is movable in a height direction, the height direction being a direction facing the print head in a case where printing is performed on the nail; and a sensor that is arranged at a position above the finger rest in the height direction as well as below the print head in the height direction, and that is movable in a movement direction and capable of detecting a nail within a detection range, the movement direction being a direction intersecting the height direction, the control method comprising performing control of height adjustment, in which the sensor is moved in the movement direction so that a first position of a nail area is included in the detection range of the sensor and then the finger rest is moved upward until the sensor detects the nail, the first position of the nail area the nail area being detected based on a captured image of the finger placed on the finger rest.

16. A control method of a nail printing apparatus, the nail printing apparatus comprising:

a print head that prints an image on a nail of a person to be printed;

a plurality of finger rests that are rests on which fingers of the person to be printed are placed and that are movable in a height direction, the height direction being a direction facing the print head in a case where printing is performed on the nail, wherein each of the plurality of finger rests can be independently moved in the height direction so that height adjustment is performed for each of the finger rests; and a sensor that is arranged at a position above the plurality of finger rests in the height direction as well as below the print head in the height direction and that is movable in a movement direction and that is capable of detecting a nail within a detection range, the movement direction being a direction intersecting the height direction, the control method comprising detecting a nail within the detection range; and capturing an image of the fingers placed on the finger rests before the height adjustment.

* * * * *